US007164259B1

(12) United States Patent
Megaw et al.

(10) Patent No.: US 7,164,259 B1
(45) Date of Patent: Jan. 16, 2007

(54) APPARATUS AND METHOD FOR CALIBRATING A BANDGAP REFERENCE VOLTAGE

(75) Inventors: David James Megaw, Tucson, AZ (US); Paul Ranucci, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 242 days.

(21) Appl. No.: 10/801,219

(22) Filed: Mar. 16, 2004

(51) Int. Cl.
*G05F 3/16* (2006.01)

(52) U.S. Cl. ..... 323/313; 323/315; 323/907

(58) Field of Classification Search ..... 323/312, 323/313, 314, 315, 316, 907, 318; 341/119; 327/539; 326/32
See application file for complete search history.

(56) References Cited

U.S. PATENT DOCUMENTS

| | | | | |
|---|---|---|---|---|
| 4,443,753 | A | 4/1984 | McGlinchey | |
| 4,808,908 | A | 2/1989 | Lewis et al. | |
| 6,075,354 | A * | 6/2000 | Smith et al. | 323/313 |
| 6,262,592 | B1 * | 7/2001 | Kim | 326/32 |
| 6,342,781 | B1 | 1/2002 | Laraia | |
| 6,556,155 | B1 * | 4/2003 | Wiles, Jr. | 341/119 |
| 6,838,864 | B1 * | 1/2005 | Di Iorio | 323/313 |
| 7,012,417 | B1 * | 3/2006 | McClure | 323/318 |
| 2004/0257150 | A1 * | 12/2004 | Farooqui | 327/539 |

OTHER PUBLICATIONS

Audy, Jonathan M. 3rd order curvature corrected Bandgap Cell. IEEE, 1996, 397-400, no month.

Azarkan, Ahmidou, Arie Van Staveren and Fabiano Fruett. A Low-noise Bandgap Reference Voltage Source with Curvature Correction. IEEE, 2002, 205-208, no month.

Gunawan, Made et al. A Curvature-Corrected Low-Voltage Bandgap Reference. IEEE, 1993, 667670, no month.

Gupta, Sandhya and William Black. A 3 to 5V CMOS Bandgap Voltage Reference with Novel Trimming. IEEE, 1997, 969-972, no month.

Leung, Ka Nang, Philip K.T. Mok and Chi Yat Leung. A 2-V 23-μA 5.3-ppm/° C 4th Order Curvature-Compensated CMOS Bandgap Reference. IEEE Custom Integrated Circuits Conference, 2002, 457-460, no month.

Michejda, John and Suk K. Kim. A Precision CMOS Bandgap Reference. IEEE Journal of Solid-State Circuits, Dec. 1984, vol. Sc 19:6: 1014-1021.

* cited by examiner

*Primary Examiner*—Jessica Han
(74) *Attorney, Agent, or Firm*—Darby & Darby P.C.; Matthew M. Gaffney

(57) ABSTRACT

An apparatus and method for producing an output reference voltage is provided. A voltage divider is configured to provide the output reference voltage from a bandgap reference voltage. The bandgap reference voltage is applied across a biased portion of the voltage divider. Additionally, a second-order temperature coefficient (TC) of the impedance of a controllable portion of the voltage divider is adjusted in response to a second-order trim signal. The first and zeroth order TCs of the controllable portion of the voltage divider are substantially independent of the second-order trim signal. In one embodiment, the controllable portion includes a resistor digital-to-analog converter (DAC) that is responsive to the second-order trim signal. The resistor DAC includes at least two different types of resistors. The second-order TCs of the two different types of resistors are substantially different.

21 Claims, 5 Drawing Sheets

APPARATUS AND METHOD FOR CALIBRATING A BANDGAP REFERENCE VOLTAGE

FIELD OF THE INVENTION

The invention is related to bandgap reference circuits, and, in particular, to an apparatus and method for calibrating a bandgap reference voltage.

BACKGROUND OF THE INVENTION

A need for a stable reference voltage is common in the design of electronic equipment. Nearly all electronic circuits require one or more sources of stable DC voltage. Bandgap voltage reference circuits are commonly used to provide a stable DC reference voltage.

A bandgap voltage reference circuit generally employs two transistors operated at different current densities. Typically, the bases of the two transistors are tied together and a resistor connects their emitters, to sense the difference in base-emitter voltages between the two transistors.

Also, the base-emitter voltage of a transistor exhibits a temperature-dependent function. A bandgap circuit typically generates a voltage with a positive first-order temperature coefficient that is approximately the same as the negative first-order temperature coefficient of the base-emitter voltage. However, the bandgap voltage may still have a temperature dependency for temperature coefficients higher than the first order. The second-order non-linearity of a bandgap voltage reference circuit is generally referred to as "curvature".

Some applications require a stable and accurate reference voltage over a large range of temperatures. In the past, acquiring such accuracy typically involved testing and trimming of an integrated circuit after it had been fabricated and assembled. Alternatively, testing and trimming can occur before assembly, or before and after assembly.

BRIEF DESCRIPTION OF THE DRAWINGS

Non-limiting and non-exhaustive embodiments of the present invention are described with reference to the following drawings, in which.

DETAILED DESCRIPTION

Figure 1:
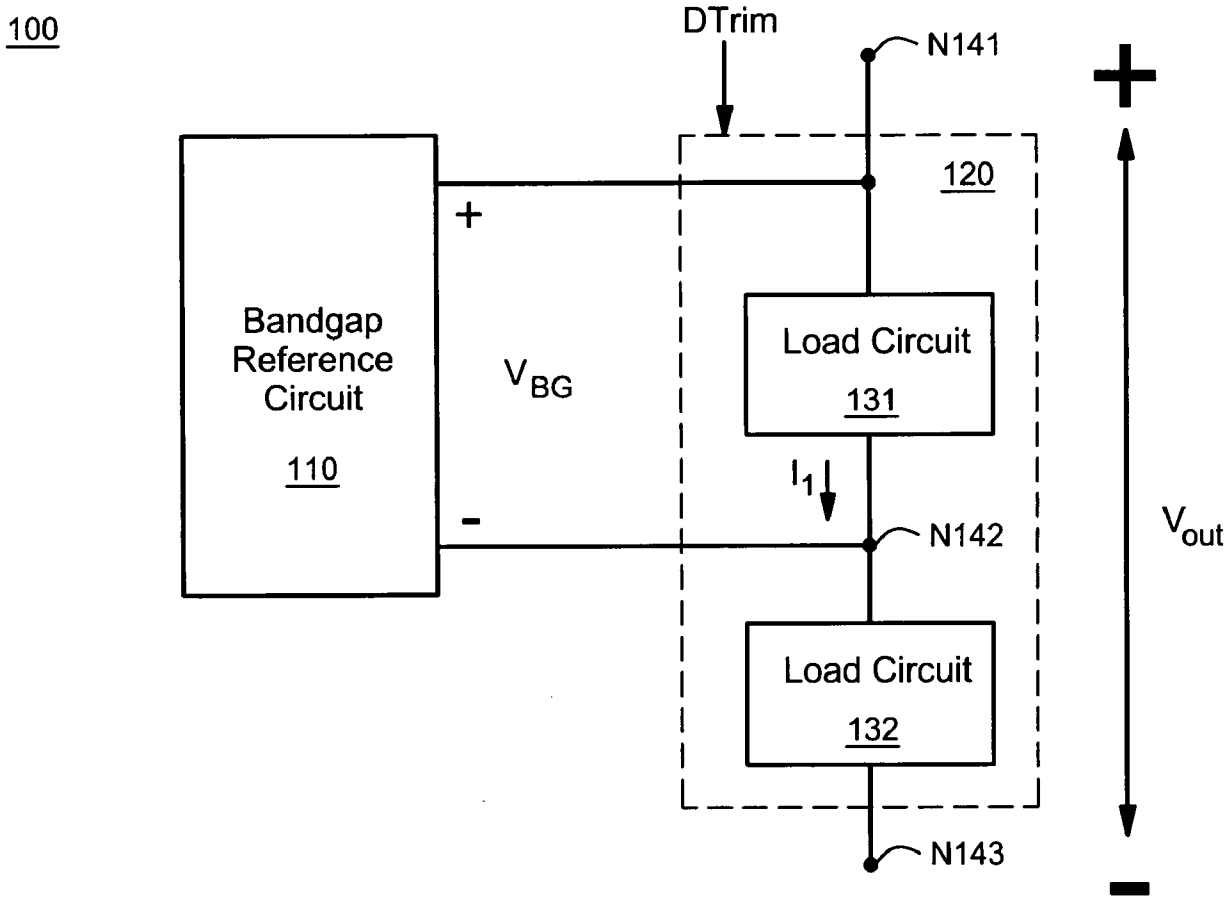
FIG. 1 shows a block diagram of an embodiment of a circuit for providing a calibrated output reference voltage.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for the terms. The meaning of "a," "an," and "the" includes plural reference, and the meaning of "in" includes "in" and "on." The term "connected" means a direct electrical connection between the items connected, without any intermediate devices. The phrase "in one embodiment," as used herein does not necessarily refer to the same embodiment, although it may. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, charge, temperature, data, or other signal.

Briefly stated, the invention is related to an apparatus and method for producing a calibrated output reference voltage. A voltage divider is configured to provide the output reference voltage from a bandgap reference voltage. The bandgap reference voltage is applied across a biased portion of the voltage divider. Additionally, a second-order temperature coefficient (TC) of the impedance of a controllable portion of the voltage divider is adjusted in response to a second-order trim signal. The first and zeroth order TCs of the controllable portion of the voltage divider are substantially independent of the second-order trim signal. In one embodiment, the controllable portion includes a resistor digital-to-analog converter (DAC) that is responsive to the second-order trim signal. The resistor DAC includes at least two different types of resistors. The second-order TCs of the two different types of resistors are substantially different.

The controllable portion of the voltage divider may be adjustable to calibrate the second-order TC of the output reference voltage, as previously described. In another embodiment, the controllable portion of the voltage divider may be adjustable to calibrate a different TC.

FIG. 1 shows a block diagram of an embodiment of circuit 100. Circuit 100 includes bandgap reference circuit 110 and voltage divider circuit 120. Voltage divider circuit 120 includes load circuit 131 and load circuit 132. Load circuit 131 is coupled between nodes N141 and N142. Also, load circuit 132 is coupled between nodes N142 and N143.

Bandgap reference circuit 110 is arranged to provide a bandgap reference voltage ($V_{BG}$) across load circuit 131. Load circuit 131 is a biased portion of voltage divider circuit 120. Voltage divider circuit 120 is arranged to provide an output voltage signal (Vout) across nodes N141 and N143 in response to signal $V_{BG}$. Also, voltage divider circuit 120 is configured to provide current I1 through voltage divider circuit 120 in response to signal $V_{BG}$. Current I1 is substantially equal to $V_{BG}$/R1, where R1 is the resistance of load circuit 131. Accordingly, current I1 is relatively independent of temperature, although it does have a temperature dependence that is substantially inversely proportional to the temperature dependence of R1.

Additionally, voltage divider circuit 120 includes a controllable portion (not shown in FIG. 1). The controllable portion may include part or all of load circuit 131, and may further include part or all of load circuit 132. Further, one or more TCs of the impedance of the controllable portion is adjustable responsive to signal DTrim. Signal Vout can be calibrated by adjusting signal DTrim and testing the resulting Vout at several temperatures.

The controllable portion may include at least one switch that is configured to open and close in response to signal DTrim. Further, the controllable portion includes a plurality of load elements. The controllable portion is arranged such that at least one of the plurality of load elements is selected in response to signal DTrim.

The controllable portion may include one or more resistor DACs that are responsive to signal DTrim. In one embodiment, the controllable portion consists of one resistor DAC. In other embodiments, the controllable portion may include more than one resistor DACs coupled in series and/or in parallel. Further, the resistor DACs may be coupled in parallel with switches coupled between the resistor DACs, such that one of the resistor DACs is selectable by signal DTrim. The resistor DAC may be coupled, in series or in parallel, with a resistor. According to one embodiment, load circuit 131 includes a resistor, and load circuit 132 includes a resistor coupled in series with a controllable portion. According to another embodiment, load circuit 132 includes a resistor, and load circuit 131 includes a resistor coupled in series with the controllable portion. In either case, the controllable portion may include a resistor DAC. An embodiment of a resistor DAC is described in greater detail below with regard to FIG. 3.

Circuit 100 may be implemented, in part or in whole, as an integrated circuit. Signal DTrim may be used for testing and trimming of circuit 100 to calibrate signal Vout after the integrated circuit has been fabricated and assembled.

Figure 2:
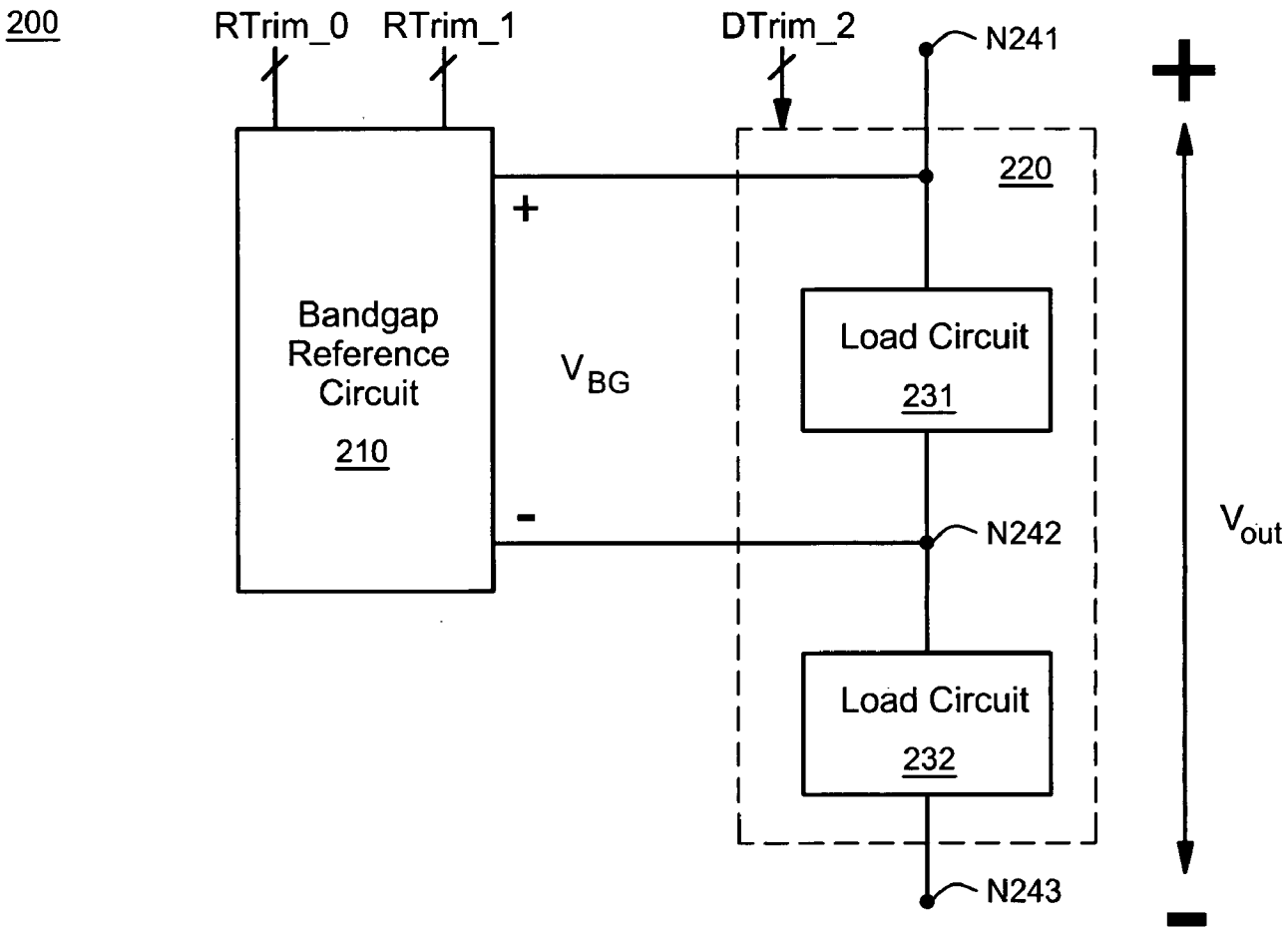
FIG. 2 shows an embodiment of the circuit of FIG. 1 in which second, first, and zeroth order trimming are substantially linearly independent.

FIG. 2 shows an embodiment of the circuit 200, in which second, first, and zeroth order trimming are substantially linearly independent. Components of circuit 200 may operate in a substantially similar manner as like-named components of circuit 100, albeit different in some ways.

Signal DTrim_2 is an embodiment of signal DTrim. Also, the controllable portion of voltage divider circuit 220 is arranged such that the second-order TC of the impedance of the controllable portion is adjustable according to signal DTtrim_2. The first and zeroth order TCs of the impedance of the controllable portion are substantially independent of signal DTrim_2.

Additionally, bandgap reference circuit 210 is arranged to provide signal $V_{BG}$ such that the zeroth and first order TCs of signal $V_{BG}$ are adjustable according to signals RTrim_0 and signal RTrim_1, respectively. Trimming of the zeroth, first, and second order TCs of signal Vout are substantially linearly independent.

The voltage associated with signal Vout is given by VBG*(1+R2/R1), where R1 is the resistance of load circuit 231, R2 is the resistance of load circuit 232. To a second order approximation, the voltage associated with signal $V_{BG}$ is given by:

$$V_{BG}=V_{BG0}*(1+\alpha_{BG}*\Delta T+\beta_{BG}*\Delta T^2)$$

$$R_1=R_{10}*(1+\alpha_1*\Delta T+\beta_1*\Delta T^2)$$

$$R_2=R_{20}*(1+\alpha_2*\Delta T+\beta_2*\Delta T^2)$$

$$\Delta T=\text{Tabs}-Tnom$$

where $V_{BG0}$ is the bandgap voltage at Tnom, 1, $\alpha_{BG}$, $\beta_{BG}$ are the zeroth, first, and second order TCs of signal VBG, respectively, Tabs is the absolute temperature, Tnom is the nominal operating temperature of bandgap reference circuit 210, $R_{10}$ is the value of R1 at Tnom, 1, $\alpha_1$ and $\beta_1$ are the zeroth, first, and second order TCs of R1, respectively, $R_{20}$ is the value of R2 at Tnom, and 1, $\alpha_2$ and $\beta_2$ are the zeroth, first, and second order TCs of R2, respectively. Accordingly, the output voltage is given (to a second order approximation) by:

$$\text{Vout}=V_{BG0}*(1+R_{20}/R_{10})*(1+\alpha_{out}*\Delta T+\beta_{out}*\Delta T^2),$$

where the first and second order TCs of signal Vout ($\alpha_{out}$ and $\beta_{out}$ respectively), are given by:

$$\alpha_{out}=\alpha_{BG}-(\alpha_2-\alpha_1)/(1+R_1/R_2)$$

$$\beta\text{out}=\beta_{BG}+(\beta_2-\beta_1+(\alpha_{BG}-\alpha_1)*(\alpha_2-\alpha_1))/(1+R_1/R_2).$$

Circuit 200 is arranged to scale signal VBG at the nominal operating point by $(1+R_{20}/R_{10})$ and make $\alpha_{out}$ and $\beta_{out}$ both substantially zero. In order to set $\alpha_{out}$ and $\beta_{out}$ to zero, the first and second order TCs of one of the resistors have the ability to be altered or trimmed. In one embodiment, resistors R1 and R2 are arranged such that $\alpha_2-\alpha_1$ is substantially equal to zero, and trimming is performed using signal Rtrim_1 such that $\alpha_{BG}$ substantially equals 0. In this embodiment, pout is substantially independent of the first-order TC $\alpha_{out}$.

This independence of the first and second order TCs allows an easier trim methodology, which can be implemented in any sequence for the first and second order coefficients. The constraining equations then become:

$$\alpha_{out}=0\rightarrow\alpha_{BG}=0,(\alpha_2-\alpha_1)=0$$

$$\beta\text{out}=0\rightarrow\beta_{BG}+(\beta_2-\beta_1)/(1+R1/R2)=0$$

Restated, these conditions are:

$$\alpha_1=\alpha_2,\alpha_{BG}=0$$

$$(\beta_1-\beta_2)=\beta_{BG}*(1+R1/R2)$$

If a $\alpha_1$ or $\alpha_2$ and $\beta_1$ or $\beta_2$ are independently controlled, then these conditions can be satisfied if appropriate values of the TCs are used for resistors in voltage divider circuit 200. The physical realization of these TCs depends upon the process, and what types of resistors are selected.

Resistors with different TCs can be added in series or parallel in order to make a composite resistor with the desired first and second order TCs. In one embodiment, two resistors RA and RB are coupled in series, with the equation for the series resistance given by:

$$RC=RA+RB=(RA0+RB0)*(1+\alpha_C*\Delta T+\alpha_C*\Delta T^2)$$

where $$\alpha_C=\alpha_A*R_A/(R_A+R_B)+\alpha_B*R_B/(R_A+R_B)$$

$$\beta_C=\beta_A*R_A/(R_A+R_B)+\beta_B*R_B/(R_A+R_B),$$

where RA0 and RB0 are the values of RA and RB, respectively, at Tnom; 1, $\alpha_A$, and $\beta_A$ are the zeroth, first, and second order TCs of resistor RA; and 1, $\alpha_B$, and $\beta_B$ are the zeroth, first, and second order TCs of resistor RB, respectively.

Accordingly, if appropriate values of $R_A$ and $R_B$ are chosen, ac can take on any value between $\alpha_A$ and $\alpha_B$ or $\beta_C$ can take on any value between $\beta_A$ and $\beta_B$. $\alpha_A$, $\alpha_B$, $\beta_A$ and $\beta_B$ are all dependent upon the process and type of resistor, so appropriate resistors are chosen such that the desired coefficient lies in between the two process-determined coefficients.

Several approaches may be employed to tailor the TCs of $R_1$ and $R_2$. In one embodiment, load circuit 231 and load circuit 232 are both 2-resistor composite resistors. During curvature trimming, the first order TCs may be kept substantially the same while adjusting the second order TCs to cancel out the curvature of signal Vout. In another embodiment, to make the realization easier, the composite resistors could be made from combinations of three resistors. When three different types of resistors are combined in series the first and second order coefficients become, respectively:

$$\alpha=\alpha_A*R_A/(R_A+R_B+R_C)+\alpha_B*R_B/(R_A+R_B+R_C)+\alpha_C*R_C/(R_A+R_B+R_C)$$

$$\beta=\beta_A*R_A/(R_A+R_B+R_C)+\beta_B*R_B/(R_A+R_B+R_C)+\beta_C*R_C/(R_A+R_B+R_C).$$

The extra degree of freedom added by the third resistor allows a wider spread of resistor TCs to be used. If a type of resistor with a very low first or second order TC is employed, the overall α and β can be adjusted nearly independently. In other embodiments, even more resistors can be used to compensate for higher order temperature coefficients and multiple combinations of 2-resistor composite resistors and 3-resistor composite resistors can be included in load circuit 231 or load circuit 232. More than three resistors can also be used. The composite resistor may include at least one switch in order to select a second order temperature coefficient. In one embodiment, the 2-resistor or 3-resistor composite includes a resistor DAC.

In one embodiment, the first order coefficients of $R_1$ and $R_2$ are substantially identical, regardless of signal DTrim_2, and a resistor DAC is included in load circuit 232. The resistor DAC is responsive to signal DTrim_2. Also, one or more additional resistors may be included in load circuit 232 to substantially match the first-order TC of load circuit 232 the first-order TC of load circuit 232. During curvature trimming, the second order TC may be fine-tuned to cancel the curvature of signal Vout. The curvature trimming is independent of the zeroth and first order trimming.

Figure 3:
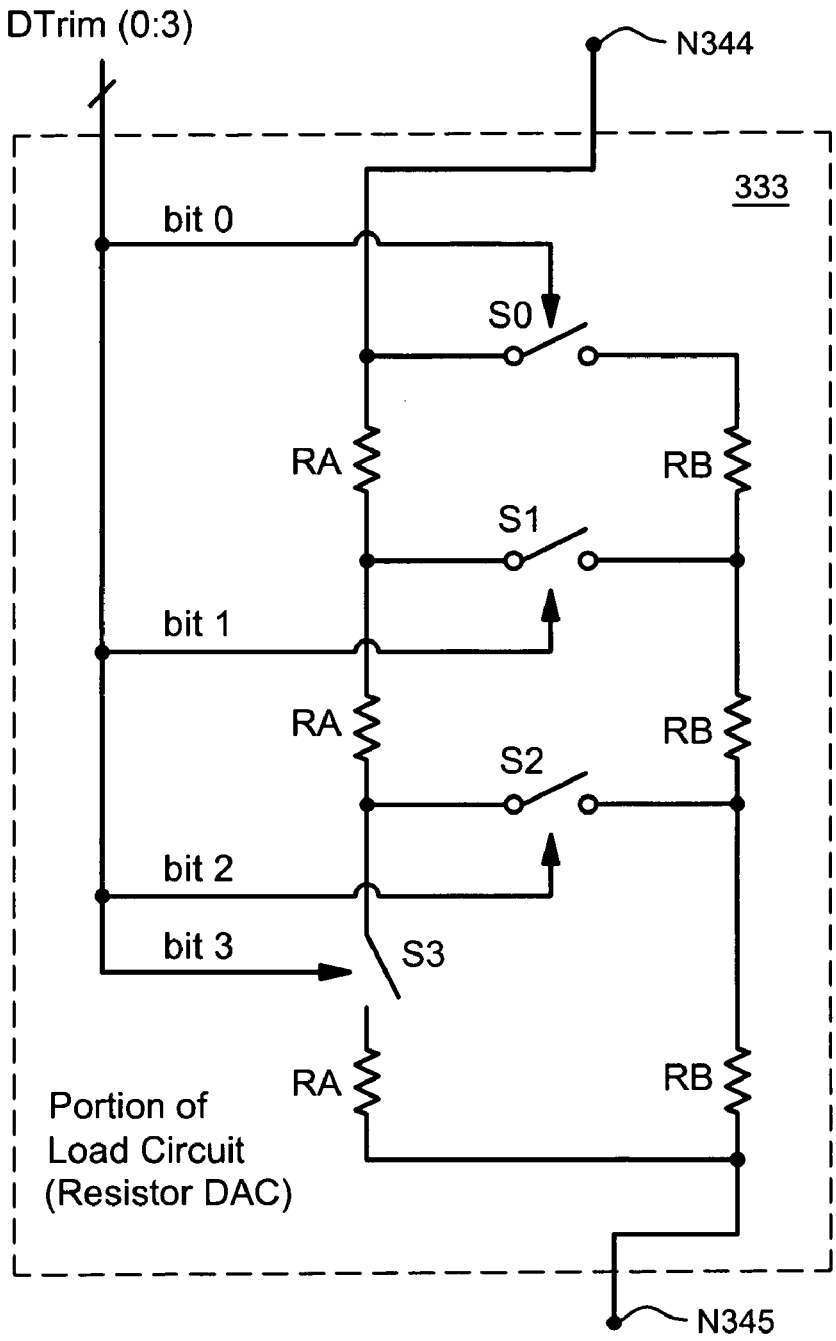
FIG. 3 schematically illustrates an embodiment of a resistor DAC that may be a portion of one of the load circuits of FIG. 1 or FIG. 2.

FIG. 3 schematically illustrates an embodiment of resistor DAC 333. Resistor DAC 333 may be used in voltage divider circuit 120 or voltage divider circuit 220. Resistor DAC 333 is coupled between nodes N344 and N345. Resistor DAC 333 may include three resistors of a first type (RA), three resistors of a second type (RB), and four switches (S0–S3). Each of the resistors of type RA has approximately the same properties as each other. Similarly, each of the resistors of type RB has approximately the same properties as each other. Each resistor RA has approximately the same resistance at temperature Tnom as each resistor RB. Similarly, each resistor RA has a resistance with approximately the same first-order TC as each resistor RB, although some variation may exist, such as a 20% difference in one embodiment. The second-order TC of the resistance of resistors of type RB is significantly differently from the second-order TC of the resistance of resistors of type RA. In one embodiment, resistor RA is a composite resistor that includes two different types of resistors.

Each switch S0–S3 is controlled by bit 0–bit 3 of signal DTrim, respectively. In one embodiment, signal DTrim has one bit that is a 1, and the remaining bits are 0. Accordingly, in this embodiment, only one switch is closed at a time.

One or both of resistors RA and RB may consist of a single resistor. In one embodiment, one of the resistors is a poly-resistor, and the other is a lightly-doped drain resistor. In other embodiments, one or both of resistors RA and RB may be composite resistors.

In one embodiment, signal DTrim is used for second-order trimming, and zeroth and first order trimming is accomplished using signal RTrim0 and Rtrim1, as described with reference to FIG. 2. In this embodiment, zeroth, first, and second order trimming are substantially linearly independent.

In another embodiment, signal DTrim may be used to trim a TC other than the first-order TC. To achieve this trimming, a resistor DAC may be used, with the resistors used in the resistor DAC selected appropriately accordingly to the TC that is to be trimmed.

In other embodiments, voltage divider circuit 130 may also be used to trim more than one different type of TC. In one embodiment, at least two resistors DACs are coupled together in parallel, with switches coupled between the resistors DAC. One of the resistor DACs may be selected signal DTrim.

Although any bandgap reference may be used with various embodiments of the invention, one embodiment of bandgap reference circuit 210 is described in further detail below.

Figure 4:
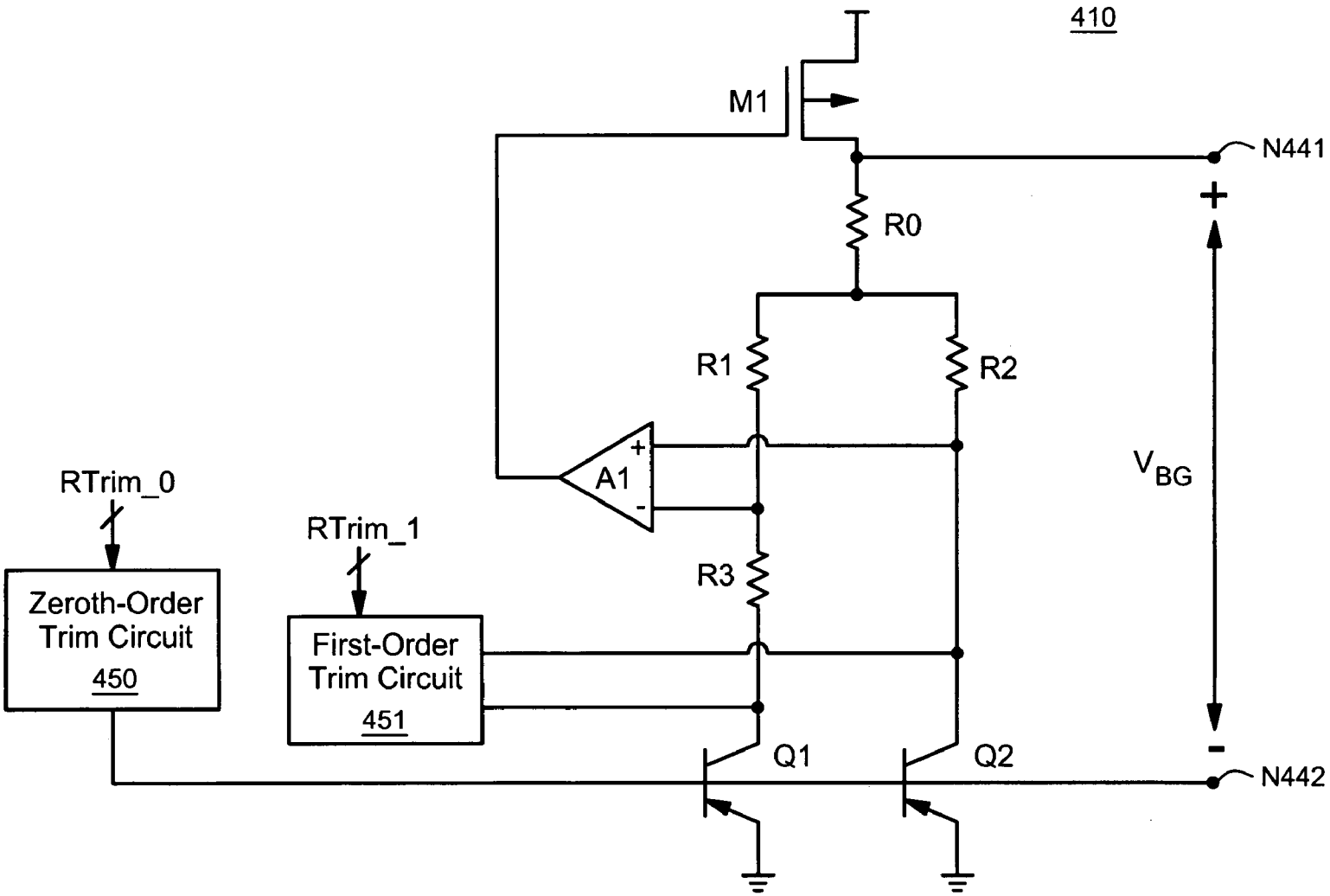
FIG. 4 schematically illustrates an embodiment of the bandgap reference circuit of FIG. 3.

FIG. 4 schematically illustrates an embodiment of bandgap reference circuit 410. Bandgap reference circuit 410 is an embodiment of bandgap reference circuit 210. Bandgap reference circuit 410 includes transistor M1, transistors Q1–Q2, operational amplifier circuit A1, resistors R0–R3, zeroth-order trim circuit 450, and first-order trim circuit 451.

Zeroth-order trim circuit 450 is configured to adjust the zeroth-order TC of signal Vout in response to signal RTrim_0. In one embodiment, zeroth-order trim circuit 450 is an adjustable current source that is controlled by signal RTrim_0.

Similarly, first-order trim circuit 451 is configured to adjust the first-order TC of signal VBG in response to signal RTrim_1. In one embodiment, first-order trim circuit 451 is an adjustable differential current source that is controlled by signal Trim_1.

Figure 5:
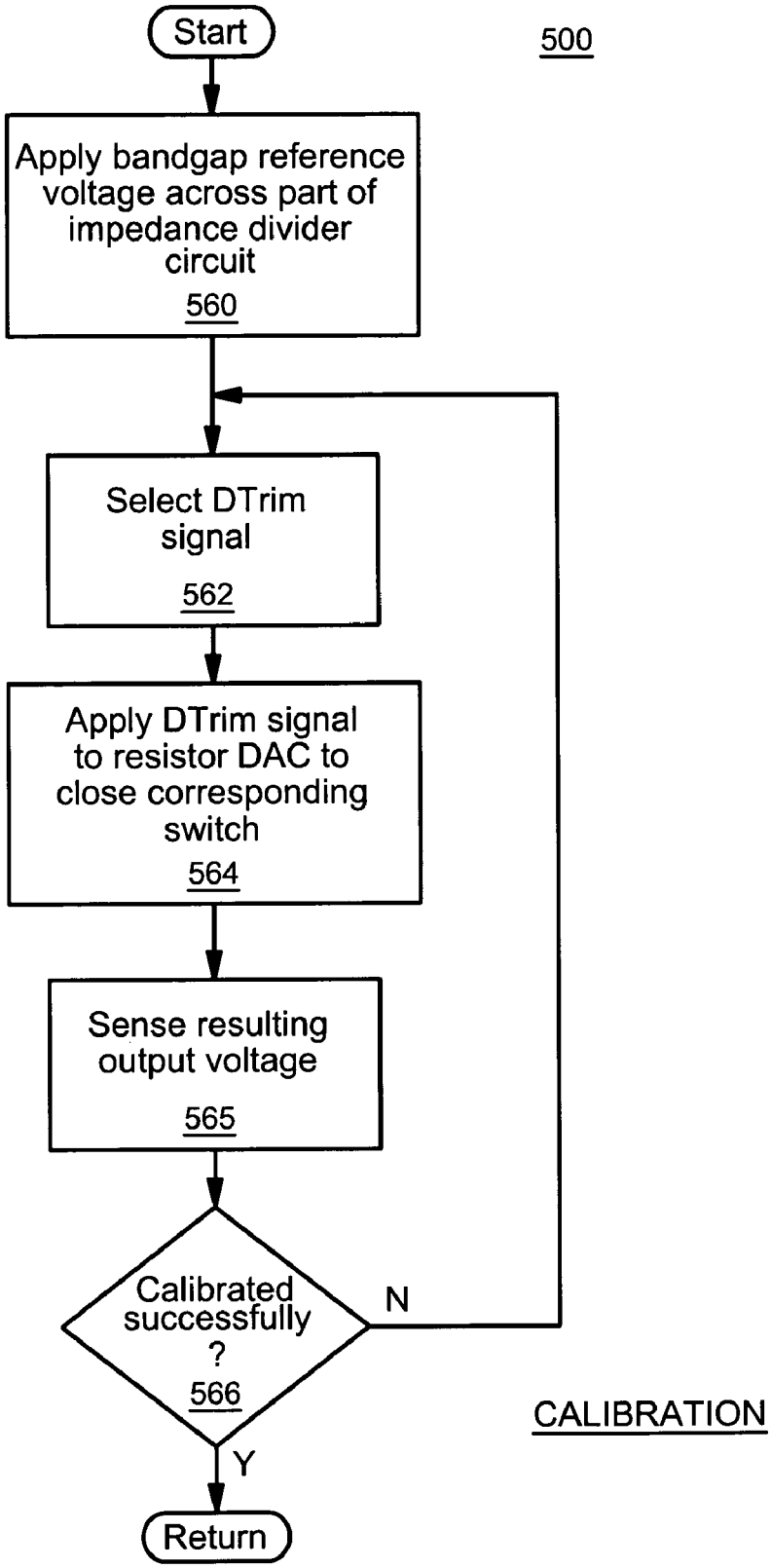
FIG. 5 shows a block diagram of a method for providing a calibrated output reference voltage, arranged in accordance with aspects of the invention.

FIG. 5 shows a block diagram of process 500. After a start block, process 500 proceeds to block 560, where a bandgap reference voltage is applied across part of a voltage divider circuit. The process then moves from block 560 to block 562, where a DTrim signal is selected. The process than advances from block 562 to block 564, where the DTrim signal is applied to a resistor DAC in the voltage divider circuit to close one of the switches in the resistor DAC that corresponds to the selected DTrim signal.

The process then continues to block 565, where an output reference voltage provided by the voltage divider circuit is sensed. The process then proceeds to decision block 566, where a determination is made as to whether the output reference voltage has been successfully calibrated. If so, the process moves to a return block. Otherwise, the process moves to block 562.

Process 500 may used to calibrate any TC of signal Vout. In one embodiment, process 500 is used to calibrate the second-order TC of signal Vout only. In this embodiment, first and second order trimming may be performed using signal RTrim_0 and RTrim_1, and described above with regard to FIG. 2. In this embodiment, second, first, and zeroth order trimming are substantially linearly independent. Accordingly, the first and second order trimming may be performed in any order. In one embodiment, first-order trimming is accomplished before the second-order trimming.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. An apparatus for providing an output reference voltage across two nodes, comprising:

a voltage divider circuit that is coupled between the two nodes, wherein the voltage divider circuit is configured to provide the output reference voltage from a bandgap reference voltage, and wherein a controllable portion of the voltage divider circuit is arranged to calibrate the output voltage by adjusting a controllable temperature coefficient of an impedance of the controllable portion in response to a trim signal.

2. The apparatus of claim 1, further comprising a bandgap reference circuit that is arranged to provide the bandgap reference voltage across a biased portion of the voltage divider circuit.

3. The apparatus of claim 2, wherein the biased portion is at least one of: distinct from the controllable portion, at least part of the controllable portion, and overlapping with the controllable portion in part.

4. The apparatus of claim 1, wherein the controllable portion includes at least one switch that is configured to open and close in response to the trim signal.

5. The apparatus of claim 1, wherein the controllable portion includes a plurality of load elements, and wherein the controllable portion is arranged such that at least one of the plurality of load elements is selected in response to the trim signal.

6. The apparatus of claim 1, wherein the controllable portion includes at least one resistor digital-to-analog converter circuit.

7. The apparatus of claim 1, wherein the voltage divider circuit is configured to provide a current through the voltage divider circuit in response to the bandgap reference voltage, wherein the current is approximately independent of temperature.

8. The apparatus of claim 1, wherein the adjustable temperature coefficient is a second-order temperature coefficient.

9. The apparatus of claim 8, wherein a first-order temperature coefficient and a zeroth-order temperature coefficient of the impedance of the controllable portion are each substantially independent of the trim signal.

10. The apparatus of claim 8, wherein the controllable portion includes at least two resistors having substantially different second-order temperatures coefficients.

11. The apparatus of claim 8, wherein the controllable portion includes a first plurality of resistors and a second plurality of resistors, wherein each of the first plurality of resistors corresponds to a first type of resistor, each of the second plurality of resistors corresponds to a second type of resistor, a second-order temperature coefficient of the first type of resistor is substantially different from a second order temperature coefficient of the second type of resistor, and the zeroth-order temperature coefficient of the first type of resistor is substantially similar to the zeroth-order coefficient of the second type of resistor.

12. The apparatus of claim 11, wherein the controllable portion further includes a plurality of switches, and wherein the plurality of switches and the first and second plurality of resistors are arranged as a resistor digital-to-analog converter circuit.

13. The apparatus of claim 12, wherein the controllable portion further includes another resistor that is coupled in series with the resistor digital-to-analog converter circuit, wherein the other resistor corresponds to another type of resistor.

14. The apparatus of claim 1, wherein a zeroth-order temperature coefficient of the impedance of the controllable portion is substantially independent of the trim signal.

15. A method for providing an output reference voltage, comprising:

applying a bandgap reference voltage across a biased portion of a voltage divider circuit to provide a reference voltage; and calibrating the reference voltage, wherein calibrating the reference voltage includes adjusting a controllable portion of the voltage divider circuit based on a trim signal, such that a zeroth-order temperature coefficient of a resistance of the controllable portion is substantially independent of the trim signal.

16. The method of claim 15, wherein adjusting the controllable portion includes:

adjusting an adjustable temperature coefficient of an impedance of the controllable portion.

17. The method of claim 16, wherein the adjustable portion includes a resistor digital-to-analog converter, adjusting the adjustable temperature coefficient includes:

providing a first trim signal to the resistor digital-to-analog converter to close at least one of a plurality of switches, and wherein calibrating the reference voltage further includes:

sensing the output voltage at a plurality of temperatures;

determining whether the reference signal has been substantially calibrated for the adjustable temperature coefficient based on the sensed output voltage; and, if not, providing a second trim signal to the resistor digital-to-analog converter to close another one of the plurality of switches.

18. The method of claim 16, wherein the adjustable temperature coefficient is a second-order temperature coefficient.

19. The method of claim 18, further comprising:

calibrating a first-order coefficient of the reference voltage, before adjusting the second-order temperature coefficient of the controllable portion.

20. The method of claim 15, wherein the controllable portion includes a plurality of load elements, and wherein adjusting of the controllable portion includes:

selecting a load element of the plurality that has a desirable temperature coefficient.

21. An apparatus for providing an output reference voltage, comprising:

a means for applying a bandgap reference voltage across a biased portion of a voltage divider circuit to provide a reference voltage; and a means for calibrating the reference voltage, wherein the means for calibrating the reference voltage includes a means for a controllable portion of the voltage divider circuit based on a trim signal, such that a zeroth-order temperature coefficient of a resistance of the controllable portion is substantially independent of the trim signal.

* * * * *

UNITED STATES PATENT AND TRADEMARK OFFICE

CERTIFICATE OF CORRECTION

PATENT NO. : 7,164,259 B1
APPLICATION NO. : 10/801219
DATED : January 16, 2007
INVENTOR(S) : David J. Megaw et al.

It is certified that error appears in the above-identified patent and that said Letters Patent is hereby corrected as shown below:

Title Page Col. 2 Item [56] (Other Publications); Line 5; Delete "667670," and insert -- 667-670, --, therefor.

Column 3; Line 40; Delete "DTtrim_2." and insert -- DTrim_2. --, therefor.

Column 3; Line 50; Delete "VBG*(1+R2/R1)," and insert -- $V_{BG}$*(1+R2/R1), --, therefor.

Column 3; Line 63; Delete "VBG," and insert -- $V_{BG}$, --, therefor.

Column 4 (Equation); Line 12 (Approx.) Delete "$\beta$out=" and insert -- $\beta_{out}$= --, therefor.

Column 4; Line 13; Delete "VBG" and insert -- $V_{BG}$ --, therefor.

Column 4; Line 20; Delete "Rtrim_1" and insert -- RTrim_1 --, therefor.

Signed and Sealed this

Twenty-ninth Day of May, 2007

JON W. DUDAS
*Director of the United States Patent and Trademark Office*